US010197239B2

(12) United States Patent
Liu et al.

(10) Patent No.: US 10,197,239 B2
(45) Date of Patent: Feb. 5, 2019

(54) ILLUMINATION APPARATUS

(71) Applicant: OSRAM GmbH, Munich (DE)

(72) Inventors: Jun Liu, Guangdong (CN); Qihui Zhang, Guangdong (CN)

(73) Assignee: LEDVANCE GMBH, Garching Bei, Munich (DE)

( * ) Notice: Subject to any disclaimer, the term of this patent is extended or adjusted under 35 U.S.C. 154(b) by 0 days.

(21) Appl. No.: 15/329,926

(22) PCT Filed: Apr. 30, 2015

(86) PCT No.: PCT/EP2015/059473
§ 371 (c)(1),
(2) Date: Jan. 27, 2017

(87) PCT Pub. No.: WO2016/023646
PCT Pub. Date: Feb. 18, 2016

(65) Prior Publication Data

US 2017/0227189 A1 Aug. 10, 2017

(30) Foreign Application Priority Data

Aug. 13, 2014 (CN) ..... 2014 1 0397352

(51) Int. Cl.

| | |
|---|---|
| ***F21V 29/00*** | (2015.01) |
| ***F21V 3/02*** | (2006.01) |
| ***F21V 29/70*** | (2015.01) |
| ***F21V 23/00*** | (2015.01) |
| ***F21V 3/06*** | (2018.01) |

(52) U.S. Cl.
CPC ..... *F21V 3/02* (2013.01); *F21V 3/061* (2018.02); *F21V 3/062* (2018.02); *F21V 23/003* (2013.01); *F21V 29/70* (2015.01)

(58) Field of Classification Search
CPC ..... F21V 29/70; F21V 3/02; F21V 3/0418; F21V 3/0436; F21V 3/0427; F21V 3/0445; F21V 5/043
See application file for complete search history.

(56) References Cited

U.S. PATENT DOCUMENTS

| | | | | |
|---|---|---|---|---|
| 7,362,486 B2 * | 4/2008 | Hayashi | ..... | G02B 7/008 359/205.1 |
| 7,408,370 B2 * | 8/2008 | Shen | ..... | H01L 24/73 257/E21.511 |

(Continued)

FOREIGN PATENT DOCUMENTS

| | | |
|---|---|---|
| WO | 2011132120 A1 | 10/2011 |
| WO | 2013179227 A2 | 12/2013 |
| WO | 2014135357 A1 | 9/2014 |

*Primary Examiner* — Peggy Neils
(74) *Attorney, Agent, or Firm* — Hayes Soloway PC

(57) ABSTRACT

The present invention relates to an illumination apparatus (100) comprising a light engine (3) and a first lampshade (1) for accommodating the light engine (3), wherein the first lampshade (1) has a first expansion coefficient, wherein the illumination apparatus (100) further comprises a second lampshade (2) for accommodating the first lampshade (1), wherein the second lampshade (2) has a second expansion coefficient smaller than the first expansion coefficient, and is configured such that the changes in size or shape of the first lampshade (1) can be restrained under a high temperature.

19 Claims, 1 Drawing Sheet

(56) References Cited

U.S. PATENT DOCUMENTS

| | | | | |
|---|---|---|---|---|
| 7,815,338 | B2 * | 10/2010 | Siemiet | F21V 3/02 362/218 |
| 8,360,599 | B2 * | 1/2013 | Ivey | F21V 23/06 362/218 |
| 8,425,081 | B2 * | 4/2013 | Osawa | F21K 9/275 362/217.08 |
| 8,668,361 | B2 * | 3/2014 | Hasnain | F21V 29/004 362/294 |
| 8,919,992 | B2 * | 12/2014 | Dellian | F21V 3/00 362/225 |
| 9,234,632 | B2 * | 1/2016 | Kawabata | H01L 33/54 |
| 2011/0216523 | A1 * | 9/2011 | Tong | F21V 5/002 362/84 |
| 2013/0033888 | A1 * | 2/2013 | Van Der Wel | F21V 1/06 362/555 |
| 2013/0094200 | A1 | 4/2013 | Dellian et al. | |
| 2014/0340896 | A1 * | 11/2014 | Verbeek | F21V 7/0008 362/235 |

* cited by examiner

100
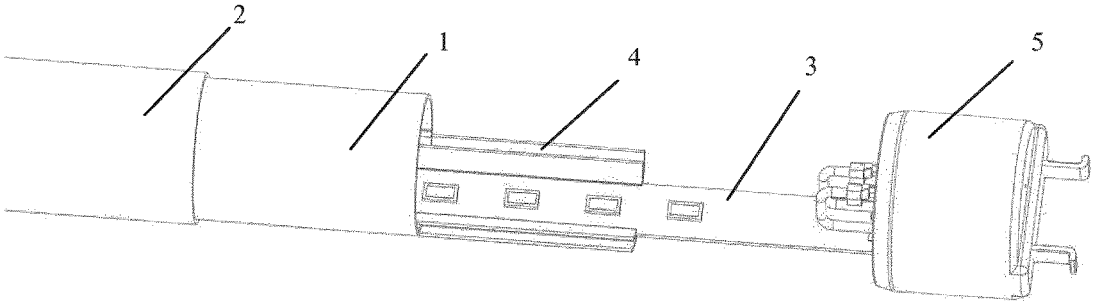

ILLUMINATION APPARATUS

TECHNICAL FIELD

The present invention relates to an illumination apparatus.

BACKGROUND ART

In order to achieve optical processing of light from a light engine and to maintain the mechanical strength of an illumination apparatus with the light engine accommodated, a lampshade made of PC (polycarbonate) material is usually provided on the illumination apparatus. This lampshade is designed as a lamp tube in e.g. a tubular illumination apparatus, and a light engine, other electronic devices, and a heat sink can all be accommodated in the lamp tube. In a general tubular illumination apparatus, a heat sink of aluminum carrying a light engine is used, and this heat sink and the light engine are provided in a lamp tube made of PC, wherein the heat sink of aluminum can both achieve heat dissipation of the light engine and function as a frame, so as to reinforce the mechanical strength of the illumination apparatus. In addition, in another kind of illumination apparatus, a full PC lamp tube is used not only for achieving optical result such as light scattering, but also for reinforcing the mechanical strength of the illumination apparatus. The lamp tube made of PC material can realize the effect of light scattering, that is to say, viewed from outside of the illumination apparatus, this lamp tube can make light from the light engine softer and more uniform after light exits and make the illuminating result more suitable for human eyes. However, the lamp tube made of PC material might undergo deformation due to thermal expansion effect under a high temperature effect during the operation of the illumination apparatus, that is to say, both the size or the volume of the lamp tube might change, and even the PC lamp tube might bend over a long time period, which greatly adversely affects the normal function as both an optical element and a mechanical fastening element.

SUMMARY OF THE INVENTION

In order to solve the above-mentioned technical problems, the present invention provides a novel illumination apparatus, wherein this illumination apparatus has a second lampshade in addition to a first lampshade that serves as an optical unit, and this second lampshade is different from the first lampshade of the illumination apparatus that is used for e.g. making light from a light source scatter, and is provided outside the first lampshade and used for restraining or maintaining the size or shape of the first lampshade such that the first lampshade does not undergo deformation due to the effect of a high temperature produced during operation of the illumination apparatus. Moreover, this second lampshade requires a low cost that is even lower than that of the first lampshade, and has good insulating performance and hardness, can not only maintain its shape at a high temperature but also limit changes in shape of the first lampshade accommodated therein.

An object of the present invention is achieved through such an illumination apparatus, which comprises a light engine and a first lampshade for accommodating the light engine, wherein the first lampshade has a first expansion coefficient, characterized in that the illumination apparatus further comprises a second lampshade for accommodating the first lampshade, wherein the second lampshade has a second expansion coefficient smaller than the first expansion coefficient, and is configured such that changes in the size or shape of the first lampshade can be restrained under a high temperature.

During normal operation of the illumination apparatus, heat in large quantities is produced, and lampshades configured to be made of PC material will be easily influenced under a long-term effect of the heat. Due to limitations caused by the material of the lampshade, this lampshade only has a high or unexpected thermal expansion coefficient, and accordingly, this lampshade would deform at a high temperature, and the size or shape thereof would change, or the lampshade would bend, which would have a strong impact on the mechanical stability and normal use of the illumination apparatus. However, according to the design of the present invention, e.g. an additional second lampshade is sleeved over the first lampshade for achieving an optical effect. This second lampshade may preferably have no optical effect, that is to say, it would not make light from a light source refracted or scattered in a way similar to the first lampshade.

Moreover, this second lampshade has a higher mechanical stability or strength than the first lampshade, and has a lower thermal expansion coefficient with respect to the first lampshade, which means that at the same high temperature, the second lampshade would not easily undergo thermal expansion, deformation, or specifically changes in the length, compared with the first lampshade. Accordingly, even if the first lampshade is subjected to expansion or changes in length at a high temperature due to its higher thermal expansion coefficient compared with the second lampshade, the second lampshade provided outside the first lampshade will restrain the changes in size or shape of the first lampshade, such that the first lampshade would not easily undergo expansion or deformation.

Further, in a situation where the second lampshade has a higher mechanical stability or strength, the first lampshade can be configured to be thinner or lighter, which means that the first lampshade is no longer required to maintain a relatively high mechanical strength due to the absence of the second lampshade, which also advantageously reduces the manufacturing cost of the first lampshade and easily meet the requirements for fire prevention.

According to a preferred embodiment of the present invention, the first lampshade is configured such that the light from the light engine is scattered and exits through the first lampshade, and the second lampshade is configured such that the light which is scatter and exits through the first lampshade is transmitted through the second lampshade. In this design, the first lampshade preferably serves as an optical element so as to realize optical processing of light from the light engine, e.g. make the same scattered or refracted. However, compared with the first lampshade, the second lampshade does not necessarily have an optical function, which is to say that the second lampshade does not have to be configured such that the light exits through the first lampshade is further scattered or refracted but rather transmitted, whereas it only has to have better thermal and mechanical performance than the first lampshade, that is to say, for example, the thermal expansion coefficient of the second lampshade is lower than that of the first lampshade so as to restrain or maintain the size or shape of the first lampshade, and the second lampshade has a mechanical strength higher than the first lampshade, which means reinforcement of the mechanical stability of the illumination apparatus or serving as a frame replacing the first lampshade so as to support the internal parts of the whole illumination apparatus.

According to a preferable embodiment of the present invention, the illumination apparatus further comprises a heat sink which is accommodated in the second lampshade, wherein the first lampshade is inserted and connected to the heat sink. Upon the first lampshade being connected to the heat sink, the heat sink can carry and support the first lampshade, and the first lampshade can be accommodated inside the second lampshade along with the heat sink, as a result, the first lampshade and the heat sink can be both carried and supported by the second lampshade.

Preferably, the first lampshade is configured to have a U-shaped cross section, and the first lampshade is inserted and connected to the heat sink in a gliding manner. The heat sink can also be configured to have U-shaped cross section, whereby upon the first lampshade being inserted and connected to the heat sink, the first lampshade and heat sink can constitute a full circle-shaped cross section and can be then form-fitted with the second lampshade having a tube shape. In addition, the first lampshade can be inserted to the heat sink by means of gliding in the heat sink, it is thus provided a detachable and convenient assembly manner.

It is preferred that the first lampshade and the second lampshade are configured to be tubular. The first lampshade and second lampshade configured to be tubular are more advantageously suitable for application of an illumination apparatus which is lighting tube, so as to provide illumination in a circumferential direction with respect to the lamp tube.

As to the embodiments of the present invention, it is advantageous that the second lampshade is made of a rigid material. It is assured accordingly that the second lampshade has a sufficient hardness or rigidity so as to assure that it, as the frame of the illumination apparatus, can advantageously support the first lampshade and other parts of the illumination apparatus or protect the same against influences from external environment.

It is preferred that the first lampshade is made of PC material, and the second lampshade is made of glass material. PC materials have good thermal conductivity and can effectively achieve optical processing of light from the light engine, while glass material is rigid, would not easily bend, have a relatively low thermal expansion coefficient, and further have good electrical insulation and require lower manufacturing cost compared with an extrusion made of aluminum and a lamp tube made of PC.

It is further preferred that the second lampshade is made of soda-lime glass material. Soda-lime glass has good hardness and a desired low thermal expansion coefficient which is much lower than the thermal expansion coefficient of plastic and of aluminum alloy. Thus, a glass lamp tube or a lamp tube made of soda-lime glass has a better dimensional stability in case where temperature varies.

It is advantageous that the first lampshade has a thickness smaller than the thickness of the second lampshade. In a situation where a second lampshade is provided, the first lampshade can be as thin or light as possible, without influencing the whole mechanical stability of the illumination apparatus.

BRIEF DESCRIPTION OF THE DRAWINGS

The accompanying drawings constitute a part of the present Description and are used to provide further understanding of the present invention. Such accompanying drawings illustrate the embodiments of the present invention and are used to describe the principles of the present invention together with the description. In the accompanying drawings the same components are represented by the same reference numbers. As shown in the drawings:

FIG. 1 shows an exploded schematic diagram of an illumination apparatus according to the present invention.

DETAILED DESCRIPTION OF THE EMBODIMENTS

FIG. 1 shows an exploded schematic diagram of an illumination apparatus 100 according to the present invention. The illumination apparatus 100 according to the present invention has a first lampshade 1, a light engine 3 which can be provided inside of the first lampshade 1, a heat sink 4, and an end cap 5. The heat sink 4 can be preferably be made of a heat-conducting plastic material or a metal material, so as to achieve efficient heat dissipation for the light engine 3. Moreover, the heat sink 4 is arranged inside the first lampshade 1 and can achieve good supporting result for parts such as the light engine 3 within the first lampshade 1. The first lampshade 1 can be configured to have a U-shaped cross section so as to be inserted and connected to the heat sink 4 in a gliding manner, and the heat sink 4 can then carry and support the first lampshade 1. The heat sink 4 can also be configured to have a U-shaped cross section so as to form a full circle-shaped cross section upon the first lampshade 1 being connected to the heat sink 4, and thus the formed structure can be form-fitted with the second lampshade 2 having a circle-shaped cross section. Alternatively, the heat sink 4 can be configured to not have a U-shaped cross section, and the first lampshade 1 can be nevertheless inserted and connected to the heat sink 4. In addition, the illumination apparatus 100 can be provided with no heat sink 4, as a result, the light engine 3 is directly arranged inside the first lampshade 1 and is carried and supported by the first lampshade 1.

In addition, the illumination apparatus 100 further comprises a second lampshade 2, which is provided outside the first lampshade 1, that is to say, the first lampshade 1 is accommodated in the second lampshade 2. Both the first lampshade 1 and the second lampshade 2 are preferably defined to have a lamp tube in a tubular shape, and accordingly, the first lampshade 1 and the second lampshade 2 may be form-fitted with each other in shape, and the outer surface of the first lampshade 1 can be in surface fitting with the inner surface of the second lampshade 2, or not in surface fitting with the same, which means that there is a gap between the outer surface of the first lampshade 1 and the inner surface of the second lampshade 2.

Both the first lampshade 1 and the second lampshade 2 are in connection with the same end cap 5. Although FIG. 1 only shows the end cap 5 provided at one end of the first lampshade 1 and the second lampshade 2, the person skilled in the art would know that the other end of the first lampshade 1 and the second lampshade 2 can also be provided with an end cap 5 or be directly connected to an external power supply. In the end cap 5, a drive circuit or an adapter for external power supply can be provided, and when the first lampshade 1 and the second lampshade 2 are mounted to the end cap 5, parts, such as an input cable, that face the lampshades and are exposed through the end cap 5, can all be accommodated in the first lampshade 1 and the second lampshade 2.

The first lampshade 1 is preferably designed to be made of PC material, and the second lampshade 2 is preferably designed to be made of glass or soda-lime glass. A person skilled in the art would know that the first lampshade 1 here can also be designed to be made of other materials having the same or similar performance, and the second lampshade 2 can also be designed to be made of other materials having the same or similar performance.

Accordingly, the first lampshade 1 has good thermal conductivity and can achieve optical processing, such as light scattering, of light from the light engine 3, such that lighting becomes softer. The second lampshade 2 is sleeved over the first lampshade 1 and restrains or maintains changes in size or shape of the first lampshade 1 occurring under high temperature by means of its low thermal expansion coefficient and high mechanical strength, namely, prevents the first lampshade 1 from undergoing thermal expansion to a great extent or in a great range, resulting in adverse effect on the normal use of the illumination apparatus 100. In addition, the first lampshade 1 can be designed to have a smaller thickness than the second lampshade 2 and have a lighter weight than the second lampshade 2, so as to reduce the manufacturing cost and complexity of the first lampshade 1.

The above is merely preferred embodiments of the present invention but not to limit the present invention. For a person skilled in the art, the present invention may have various alterations and changes. Any alterations, equivalent substitutions, improvements, within the spirit and principle of the present invention, should be covered in the protection scope of the present invention.

LIST OF REFERENCE SIGNS

1 first lampshade
2 second lampshade
3 light engine
4 heat sink
5 end cap
100 illumination apparatus

The invention claimed is:

1. An illumination apparatus comprising a light engine and a first lampshade for accommodating the light engine, wherein the first lampshade has a first expansion coefficient, and is configured such that the light engine is not carried by the first lampshade, characterized in that the illumination apparatus further comprises a second lampshade for accommodating the first lampshade, wherein the second lampshade has a second expansion coefficient smaller than the first expansion coefficient, and is configured such that changes in size or shape of the first lampshade can be restrained under a high temperature, and further characterized in that the illumination apparatus further comprises a heat sink which is accommodated in the second lampshade, wherein the first lampshade is inserted and connected to the heat sink.

2. The illumination apparatus according to claim 1, characterized in that the first lampshade is configured such that the light from the light engine is scattered and exits through the first lampshade, and the second lampshade is configured such that the light which is scattered and exits through the first lampshade is transmitted through the second lampshade.

3. The illumination apparatus according to claim 1, characterized in that the first lampshade is configured to have a U-shaped cross section, and the first lampshade is inserted and connected to the heat sink in a gliding manner.

4. The illumination apparatus according to claim 1, characterized in that the first lampshade and the second lampshade are configured to be tubular.

5. The illumination apparatus according to claim 1, characterized in that the second lampshade is made of a rigid material.

6. The illumination apparatus according to claim 1, characterized in that the first lampshade is made of polycarbonate (PC) material, and the second lampshade is made of glass material.

7. The illumination apparatus according to claim 6, characterized in that the second lampshade is made of soda-lime glass material.

8. The illumination apparatus according to claim 1, characterized in that the first lampshade has a thickness smaller than the thickness of the second lampshade.

9. The illumination apparatus according to claim 1, characterized in that the light engine is directly arranged inside the first lampshade and is carried by the heat sink.

10. The illumination apparatus according to claim 1, characterized in that there is a gap between an outer surface of the first lampshade and an inner surface of the second lampshade.

11. The illumination apparatus according to claim 1, characterized in that the illumination apparatus further comprises a first end cap provided at a first end of both the first lampshade and the second lampshade.

12. The illumination apparatus according to claim 11, characterized in that the first lampshade and the second lampshade are in connection with the first end cap.

13. The illumination apparatus according to claim 11, characterized in that the illumination apparatus further comprises at least one of a drive circuit and an adapter for an external power supply provided within the first end cap.

14. The illumination apparatus according to claim 11, characterized in that the illumination apparatus further comprises a second end cap provided at a second end of both the first lampshade and the second lampshade.

15. The illumination apparatus according to claim 11, characterized in that a second end of the first lampshade and the second lampshade is configured to be connected to an external power supply.

16. An illumination apparatus comprising a light engine and a first lampshade for accommodating the light engine, wherein the first lampshade has a first expansion coefficient, characterized in that the illumination apparatus further comprises a second lampshade for accommodating the first lampshade, wherein the second lampshade has a second expansion coefficient smaller than the first expansion coefficient, and is configured such that changes in size or shape of the first lampshade can be restrained under a high temperature, and further characterized in that the illumination apparatus further comprises a heat sink which is accommodated in the second lampshade, wherein the first lampshade is connected to the heat sink in a gliding manner.

17. The illumination apparatus according to claim 16, wherein the first lampshade and the heat sink connect in a manner resulting in a full circle-shaped cross section geometry.

18. An illumination apparatus comprising a light engine and a first lampshade for accommodating the light engine, wherein the first lampshade is made of polycarbonate (PC) material and has a first expansion coefficient, characterized in that the illumination apparatus further comprises a second lampshade for accommodating the first lampshade, wherein the second lampshade is made of soda-lime glass material, and has a second expansion coefficient smaller than the first expansion coefficient, and is configured such that changes in size or shape of the first lampshade can be restrained under a high temperature, further characterized in that each of the first lampshade and the second lampshade is of U-shaped cross section geometry, and further characterized in that the illumination apparatus further comprises a heat sink which is accommodated in the second lampshade, wherein the first lampshade is inserted and connected to the heat sink.

19. The illumination apparatus according to claim 18, characterized in that the second lampshade is sleeved over the first lampshade.

* * * * *